US005738178A

United States Patent [19]

Williams et al.

[11] Patent Number: 5,738,178

[45] Date of Patent: Apr. 14, 1998

[54] METHOD AND APPARATUS FOR NAVIGATIONAL DRILLING WITH A DOWNHOLE MOTOR EMPLOYING INDEPENDENT DRILL STRING AND BOTTOMHOLE ASSEMBLY ROTARY ORIENTATION AND ROTATION

[75] Inventors: Michael P. Williams, The Woodlands, Tex.; Ralph Ehlers, Winsen, Germany

[73] Assignee: Baker Hughes Incorporated, Houston, Tex.

[21] Appl. No.: 560,070

[22] Filed: Nov. 17, 1995

[51] Int. Cl.[6] ..... E21B 4/00; E21B 7/04

[52] U.S. Cl. ..... 175/61; 175/73

[58] Field of Search ..... 175/61, 73, 74

[56] References Cited

U.S. PATENT DOCUMENTS

| | | | |
|---|---|---|---|
| Re. 33,751 | 11/1991 | Geczy et al. | 175/61 |
| 4,374,547 | 2/1983 | Nguyen et al. | 175/45 |
| 4,610,307 | 9/1986 | Jurgens et al. | 175/320 |
| 4,698,794 | 10/1987 | Kruger et al. | 367/83 |
| 4,732,225 | 3/1988 | Jurgens et al. | 175/92 |
| 4,807,708 | 2/1989 | Forrest et al. | 175/45 |
| 5,022,471 | 6/1991 | Maurer et al. | 175/75 |
| 5,050,692 | 9/1991 | Beimgraben | 175/61 |
| 5,099,931 | 3/1992 | Krueger et al. | 175/75 |
| 5,113,953 | 5/1992 | Noble | 175/61 |
| 5,156,222 | 10/1992 | Jurgens et al. | 175/76 |
| 5,215,151 | 6/1993 | Smith et al. | 175/61 X |
| 5,265,682 | 11/1993 | Russell et al. | 175/45 |
| 5,311,952 | 5/1994 | Eddison et al. | 175/61 |
| 5,316,093 | 5/1994 | Morin et al. | 175/74 |
| 5,316,094 | 5/1994 | Pringle | 175/74 |
| 5,339,913 | 8/1994 | Rives | 175/73 |
| 5,343,967 | 9/1994 | Kruger et al. | 175/75 |
| 5,360,075 | 11/1994 | Gray | 175/61 |
| 5,394,951 | 3/1995 | Pringle et al. | 175/61 |
| 5,419,405 | 5/1995 | Patton | 175/27 |
| 5,485,889 | 1/1996 | Gray | 175/61 |

*Primary Examiner*—Hoang C. Dang
*Attorney, Agent, or Firm*—Trask, Britt & Rossa

[57] ABSTRACT

A subterranean drilling assembly for linear and nonlinear drilling. A downhole motor-based bottomhole assembly with a bit deflection device includes a torque compensation device and is secured to the drill string via a swivel assembly to permit independent rotation of the string and the bottomhole assembly. In the case of a drill pipe string, the string may be rotated continuously during both linear and nonlinear drilling to reduce drag. In the case of a tubing string, the bottomhole assembly is rotated by the torque compensation device during straight drilling. In both cases, the torque compensation device is employed to adjust TFO for nonlinear drilling when the bottomhole assembly is not rotated. In an alternative embodiment, a torque-sensitive clutch is employed in lieu of the torque compensation device to provide rotational orientation to, and rotation of, the bottomhole assembly.

24 Claims, 3 Drawing Sheets

METHOD AND APPARATUS FOR NAVIGATIONAL DRILLING WITH A DOWNHOLE MOTOR EMPLOYING INDEPENDENT DRILL STRING AND BOTTOMHOLE ASSEMBLY ROTARY ORIENTATION AND ROTATION

BACKGROUND OF THE INVENTION

1. Field of the Invention

The present invention relates to directional drilling and, more specifically, to so-called navigational drilling, wherein a bottomhole assembly including a downhole motor of the positive-displacement or turbine type is employed to drill both linear and nonlinear segments of a borehole to follow a desired path. In a preferred embodiment, the invention permits continuous rotation of a string of drill pipe above the bottomhole assembly while compensating the bottomhole assembly for reactive torque forces induced in the assembly by the downhole motor and either maintaining the bottomhole assembly in a rotationally static position, rotating the bottomhole assembly, or permitting the bottomhole assembly to rotate in a controlled fashion independently of the drill string.

2. State of the Art

Navigational drilling is a commercially viable technology employed in oil and gas exploration. Commercial navigational drilling bottomhole assemblies fielded in the past ten years have employed turbines or positive-displacement (Moineau principle or, most recently, vane-type) motors (hereinafter generically termed "downhole motors" or "motors") secured to the end of a drill string extending to the rig floor. A single or multiple-bend sub or housing is employed, preferably below the motor power section, to angle the motor drive shaft and hence the axis of the drill bit secured to the shaft, at a slight angle (generally on the order of 4° or less) to the axis of the motor and thus to the drill string immediately above the motor. Other techniques employed in the past to angle or laterally bias the bit with respect to the string axis include the use of an angled bearing sub at the motor and the use of one or more eccentric stabilizers. Exemplary patents disclosing bottomhole assemblies of the aforementioned types and others are disclosed in U.S. Pat. Nos. 5,343,967; 4,807,708; 5,022,471; 5,050,692; 4,610,307; and Re 33,751. Such assemblies may be termed generically to include "deflection devices" of any type known in the art, the term deflection device as used herein meaning an element or combination of elements in a bottomhole assembly for angling the drill bit axis with respect to either the motor, the entire bottomhole assembly, or the drill string for directional (oriented) drilling purposes, or that cause a bias in the drill bit side loading such that directional drilling is achieved through the side-cutting action of the drill bit under the influences of the lateral bias.

Steerable bottomhole assemblies using downhole-adjustable bent subs or housings as well as assemblies using extendable steering pads on one or multiple sides of the assembly have also been disclosed, but are not in widespread or even limited commercial use to the knowledge of the inventors. Moreover, such assemblies are complex, expensive to build, and currently of questionable reliability.

Returning to the fixed-angle (non-adjustable while deployed in the wellbore) type of bottomhole navigational drilling assembly, it should be noted that the downhole drilling motor is in continuous operation to rotate the drill bit at the end of the string, whether a straight or a curved borehole trajectory is desired. When it is desired to drill straight ahead, right-hand (clockwise, looking down) drill string rotation via a rotary table or top drive is superimposed upon the right-hand rotation of the bit effected by the motor. In such a manner, the slight angle of deviation between the bit axis and the motor or string axis, or the bias in drill bit side loading, is compensated and rendered neutral with respect to influence on wellbore trajectory, although in actual practice the "straight" borehole may spiral or corkscrew about the intended "straight" path by virtue of other influences. When a curved or nonlinear borehole segment is to be drilled, rotation of the string is stopped, and the rotational orientation angle of the output shaft and drill bit (tool face orientation or TFO) is adjusted to a desired heading by incremental drill string rotation effected from the surface, which is monitored by a steering or directional-orientation tool (DOT) or via a measurement-while-drilling (MWD) assembly, the sensors of such instruments being placed as close as possible to the motor for accuracy.

While navigational drilling systems employing apparatus and the basic methods as described above have been commercially successful, at least one major drawback remains. Specifically, when in the directional or oriented drilling mode, the stationary drill string above the motor results in greatly increased friction between the drill string and the wall of the borehole along the longitudinal wellbore axis, which phenomenon is responsible for "slip-stick" behavior of the string wherein the string may alternately seize and release in the borehole, both axially and rotationally. When string angular or rotational orientation is attempted from the rig floor, this slip-stick behavior may cause a correct TFO to deviate as frictional forces and reactive torque reduce or increase immediately after a reading is taken. Moreover, the drill string may actually "wind-up" while it is being rotated, the extent of such wind-up varying with the reactive (left-hand) torque from the motor and with the angular or rotational elasticity or compliance of the drill string. When the string relaxes and unwinds, TFO again may be vastly altered.

It has also been proposed to employ bottomhole assemblies including downhole motors at the end of coiled tubing strings, given the great rig time advantage coiled tubing offers over the use of conventional drill pipe joints. However, coiled tubing cannot be rotated from the surface, even to a limited degree for bottomhole assembly orientational purposes and certainly not for rotating the bottomhole assembly on a continuing basis. Therefore, a fixed-angle or fixed-bias bottomhole assembly cannot be used when the ability to drill both straight ahead and on a curve is desired. A state-of-the-art coiled tubing-run bottomhole assembly must, as a consequence, include another type of orienting mechanism to vary the orientation of the bit axis between coincident with and angled with respect to the motor or string. One such apparatus is disclosed in U.S. Pat. No. 5,311,952, issued on May 17, 1994 to Eddison et al. In addition to the problem of angular adjustment, bottomhole assemblies run on coiled tubing may present control problems for the reactive torque generated by the downhole motor, which at its maximum (incipient motor stall) cannot be effectively accommodated by the coiled tubing in the same manner as with relatively more torsionally rigid and robust drill pipe.

In short, state-of-the-art drill pipe-run and coiled tubing-run navigational drilling systems each possess some disadvantages and limitations, rendering their performance less than optimum.

SUMMARY OF THE INVENTION

In contrast to the prior art, the drilling system of the present invention provides simple but elegant and robust solutions to the problems heretofore encountered using a conventional, steerable, motorized bottomhole assembly at the end of a drill pipe string or at the end of coiled tubing. The present invention has utility in fixed-angle as well as adjustable-angle bottom hole assemblies, and in bottom hole assemblies wherein steerability is achieved by imparting a lateral bias (either fixed in orientation and/or magnitude or variable in either or both) to the bit or other portion of the assembly.

With respect to a drill pipe-run bottomhole assembly, the invention provides the ability to continuously rotate the drill string during both straight and nonlinear drilling segments. One apparatus to provide this ability comprises a preferably lockable swivel assembly deployed downhole in combination with a static left-hand turbine and drilling fluid flow distribution module comprising a torque compensation assembly and controlled by a survey or steering module monitoring the borehole trajectory. When in an oriented or directional mode, the apparatus of the invention precisely provides the required right-hand torque to compensate for the left-hand reactive torque generated by the motor, thus maintaining a fixed TFO or controlled continuous or discontinuous variation thereof. When in rotational mode, the invention may provide less or more compensatory torque, respectively, resulting in a controlled and slow left-hand or right-hand rotation of the motor while the motor-powered drill bit turns in a net right-hand manner at a speed sufficient to provide adequate drilling progress. Alternatively, when run in rotational mode on a drill pipe string, the swivel assembly may be locked and the assembly rotated by the string.

In both modes of drilling, the drill string above the bottomhole assembly continues to rotate, lessening axial or longitudinal friction, slip-stick and wind-up. The reduction in axial drag between the drill string and the borehole wall permits much more precise and optimized application and control of weight on bit via drill string slack-off from the rig floor for maximum ram of penetration (ROP), as well as much-improved TFO control. This advantage is particularly important when conducting extended-reach deviated drilling, wherein drill string drag becomes very substantial and fixed-TFO drilling operations may be either problematic or unfeasible.

The apparatus of the present invention may be employed with a closed-loop navigation system wherein bit position and borehole orientation are compared to a pre-programmed path and corrective measures automatically taken, or via an operator-controlled joystick or fly-by-wire system wherein borehole position and trajectory data are relayed to a surface control module by wireline, mud pulse, acoustic, electromagnetic or other downhole communications systems, and the operator adjusts the path of the bottomhole assembly as desired. A combination of the two approaches, providing a closed-loop control with an operator override, may also be employed.

In the context of coiled tubing-run motorized bottomhole assemblies, the apparatus of the present invention provides the ability to run a fixed or adjustable-angle bent sub below the motor for drilling both straight and curved borehole segments. While in directional mode, the apparatus of the invention provides a precisely fixed and corrected TFO via torque compensation. While in a linear drilling mode, the apparatus again provides rotation of the bottomhole assembly below the swivel via disequilibrium torque compensation, thus compensating for the angled drill bit axis. As an additional feature of the invention, a thruster of certain design as known in the art may be employed to advance the bottomhole assembly when run on coiled tubing and further aid in precise application of drill bit loading.

As noted above, whether employed with drill pipe or coiled tubing, the swivel assembly may be selectively lockable to permit or prevent relative rotation between the bottomhole assembly and the string.

An alternative embodiment for effecting rotation of the bottomhole assembly without string rotation would employ a torque-.sensitive slip clutch or torque-sensitive visco-clutch which would be actuated by the reactive (left-hand) torque of the motor at some given torque to effect slow left-hand rotation of the bottomhole assembly during straight drilling. The alternative embodiment is believed to have particular applicability to short-radius drilling, wherein rapid and marked changes in wellbore orientation are effected over short drilling intervals. For orientation purposes, pulses of high drilling fluid flow could be used to incrementally rotate the assembly. Curved or oriented drilling would be effected with drilling fluid flow below the threshold for clutch release. This embodiment of the invention is somewhat less preferred, as it would restrict power output from the motor and thus ROP during nonlinear drilling.

DETAILED DESCRIPTION OF THE PREFERRED EMBODIMENTS

Figure 1:
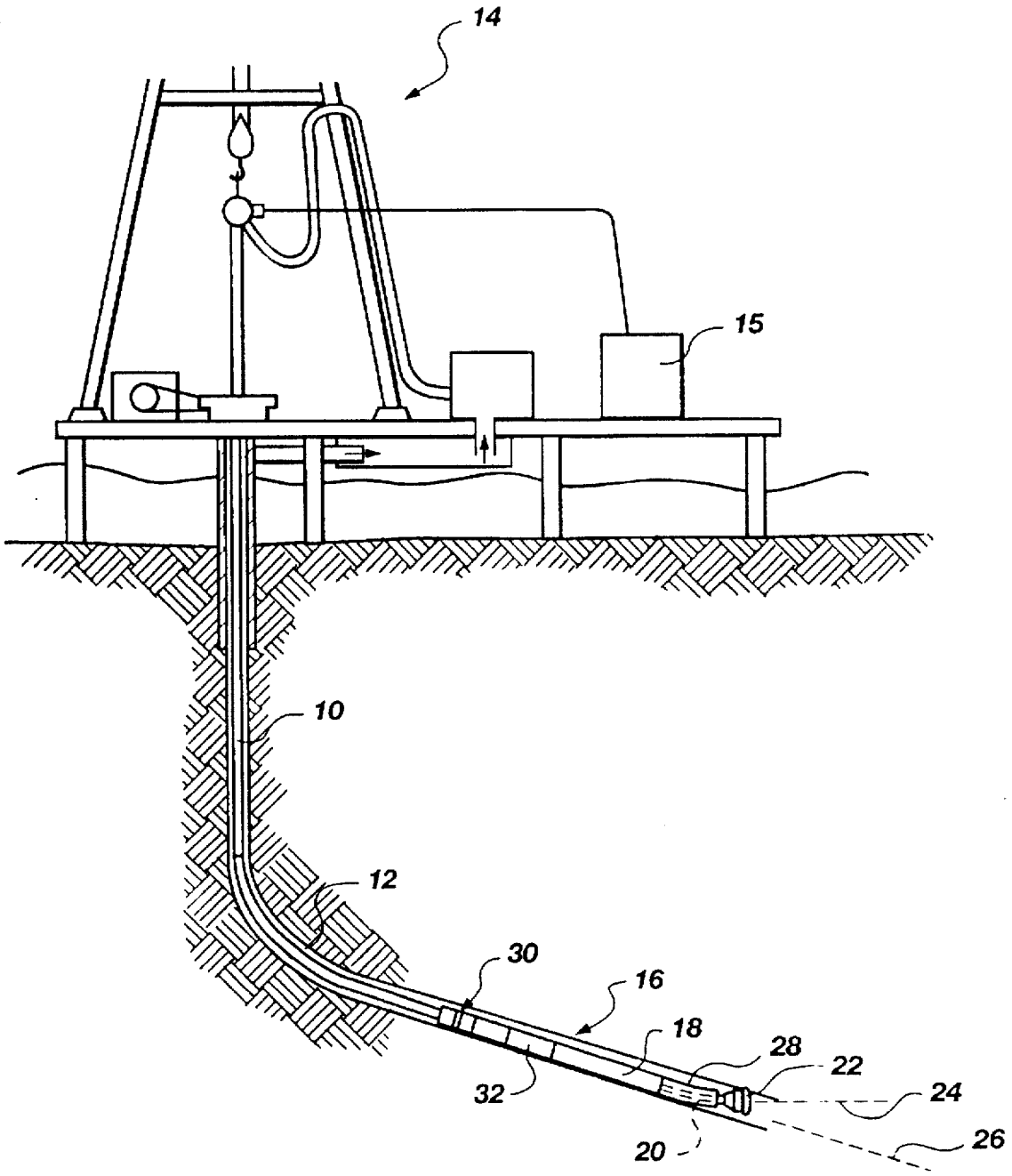
FIG. 1 is a schematic of a bottomhole assembly using the apparatus of the present invention and including a motor and an exemplary deflection device run in a well bore at the end of a pipe or coiled tubing string.

Referring now to FIG. 1 of the drawings, drill string 10 extends into subterranean borehole 12 from drilling rig 14 on the earth's surface. Drill string 10 may comprise either a plurality of joints of drill pipe, other jointed tubular, or a continuous tubular coiled tubing string, all as well known in the art. Bottomhole assembly 16 in accordance with the present invention is secured to the lower end of drill string 10.

Bottomhole assembly 16 includes a downhole motor 18 having an output shaft 20 to which a drill bit 22 is secured. Downhole motor 18 may comprise a fluid-driven positive-displacement (Moineau or vane-type) motor, or a drilling turbine, again motors of all types being well known in the art. An exemplary deflection device for angling the axis 24 of the drill bit 22 with respect to the axis 26 of the downhole motor 18 is also included in bottomhole assembly 16, in this instance the deflection device comprising a single-bend sub 28 interposed between motor 18 and bit 22. As previously described herein, the deflection device may comprise any one of a number of different structures or assemblies. An excellent overview of different types of deflection devices comprising the state of the art is provided by the aforementioned U.S. Patent 5,022,471, the disclosure of which is incorporated herein by this reference. A deflection device may also be said (in certain instances) to provide an angle between the axis 26 of downhole motor 18 and the axis 24 of drill bit 22, as in the case wherein one or more eccentric or offset stabilizers are employed to tilt or angle the motor and thus the entire bottomhole assembly rather than just the axis of the drill bit. A deflection device may also be said, in certain instances, to impart a lateral bias or side load to the drill bit without regard to a specific (either fixed or adjustable) angular relationship between the bit or bottomhole assembly axis and the drill string above. However, it is preferred to employ a deviation device which provides the requisite angle below the downhole motor 18.

Bottomhole assembly 16 is secured to the lower end of drill string 10 via a swivel assembly 30, which is preferably selectively lockable to preclude mutual rotation between drill string 10 and bottomhole assembly 16.

Figures 2, 3:
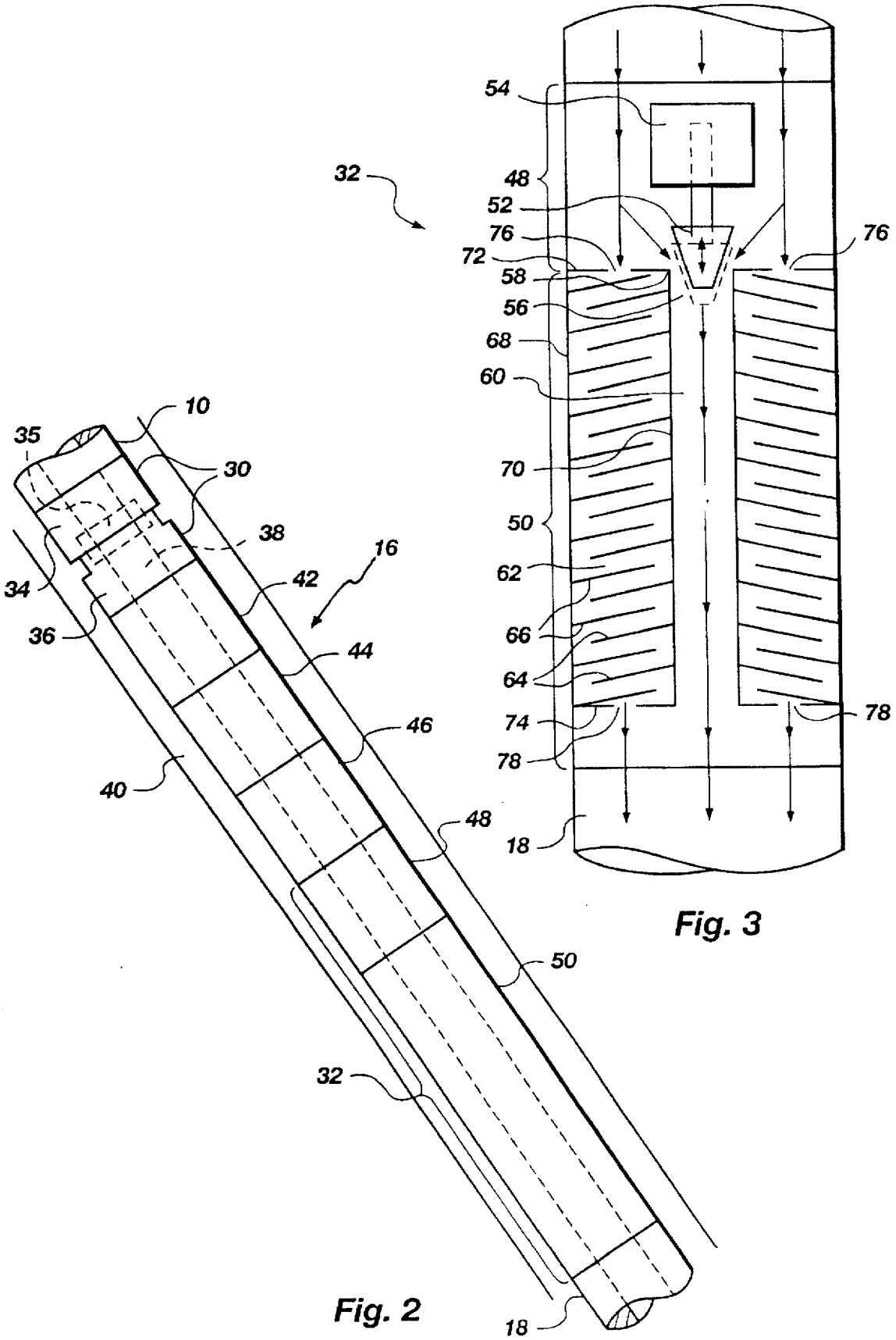
FIG. 2 is an enlarged schematic of the component parts of a first, preferred embodiment of the apparatus of the present invention interposed between the drill string and the downhole motor of the bottomhole assembly.
FIG. 3 is an enlarged sectional schematic of a flow distribution and torque control assembly according to the present invention for selectively altering compensatory right-hand torque applied to the downhole motor to counter the reactive left-hand torque generated by the motor under load.

Bottomhole assembly 16 also includes a torque compensation assembly 32 below swivel assembly 30, details of torque compensation assembly 32 being depicted in FIG. 3 of the drawings. Torque compensation assembly 32, in its preferred form, is a drilling fluid flow responsive device which generates torque in the bottomhole assembly. The torque is preferably a right-hand torque for compensation of the reactive left-hand torque generated by downhole motor 18 when driving bit 22. Torque compensation assembly 32, with ancillary components as discussed below with respect to FIG. 3, provides the ability to stabilize bottomhole assembly 16 (or at the least downhole motor 18) against rotational movement which would otherwise be induced due to the reactive torque generated by motor 18 and due to the presence of swivel assembly 30 in an unlocked mode. Torque compensation assembly 32 also provides the ability to rotate bottomhole assembly 16 (or, again, at the very least motor 18 and bit 22) during a drilling operation independent of any rotation or lack thereof of drill string 10. Such bottomhole assembly rotation may be either left-hand, responsive to the reactive torque of motor 18 but controlled within a desired range, or right-hand, overcoming the reactive motor torque and again within a desired range, such as, by way of example only, between ten and twenty revolutions per minute.

Referencing FIG. 2, swivel assembly 30 and torque compensation assembly 32 are depicted with other elements of the invention in an enlarged schematic of the upper or proximal portion of bottomhole assembly 16, extending from the upper end of downhole motor 18 to the lower end of drill string 10.

Describing the elements in FIG. 2 from top to bottom and right to left, drill string 10 may comprise a plurality of joints of drill pipe or other jointed tubular extending upwardly to the surface, the bottom joints of the pipe string optionally comprising heavy-walled drill collars, as desired and as well known in the art. Drill string 10 may alternatively comprise a continuous length of coiled tubing extending to the surface, or several lengths joined end-to-end in the case of a very deep or highly extended borehole.

Swivel assembly 30 provides the ability to rotationally couple and de-couple drill string 10 and bottomhole assembly 16, and includes upper and lower housings 34 and 36 connected by a bearing assembly of sealed roller, journal or other bearing design known in the art to permit free, unconstrained mutual rotation of the upper and lower housings 34 and 36. A thrust bearing, also as known in the art, should be incorporated in swivel assembly 30 to accommodate axial loading due to applied drill string weight. It is self-evident that a positive hydraulic seal is to be preserved between the bore 38 of swivel assembly 30 and the borehole annulus 40 surrounding the drill string 10 and bottomhole assembly 16 to prevent diversion of drilling fluid flow from drill string 10 into annulus 40. It may also be desirable, although not a requirement, that the swivel assembly be substantially pressure-balanced, as known in the downhole drilling and tool arts, so that differences between drill string and annulus pressure do not give rise to additional axial bearing thrust loads. Integral to swivel assembly 30 is a locking mechanism 35 by which upper and lower housings 34 and 36 may be selectively engaged to transmit large torsional loads across the swivel assembly 30. The design of the locking mechanism is not critical to the invention, and may comprise any one of a variety of mechanical, hydraulic, or electro-mechanical or electro-hydraulic mechanisms known in the art for rotational locking and release purposes. A j-slot mechanism, responsive to axial movement of the drill string or to hydraulic drilling fluid pressure, is one relatively simple alternative. Solenoid-controlled mechanical or hydraulic mechanisms have also proven reliable for similar applications.

Below swivel assembly 30, telemetry and communications module 42 provides means for two-way data and control communication between a surface control module 15 on drilling rig 14 and bottomhole assembly 16. Communications may be effected between surface control module 15 and module 42 via a non-physical or intangible communications link based upon mud-pulse telemetry (either positive or negative, both as known in the art), acoustic telemetry, or electromagnetic telemetry, as known in the art. Alternatively, communication may be effected via a hard-wired communications link such as a retrievable wireline and wet-connector system, a wireline installed in coiled tubing, or drill pipe having an insulated conductor in or on the wall thereof. With such an arrangement, either a slip-ring conductor assembly incorporated in swivel assembly 30 or an electromagnetic or other short-hop interface as known in the art would be employed between module 42 and the conductor extending upward from the bottomhole assembly in order to provide a communication link to cross swivel assembly 30. If a hard-wired communication link is employed, a side-entry sub may be incorporated in the drill string between rig 14 and bottomhole assembly 16, if desired, or a slip-ting conductor assembly may be located at rig 14 to avoid the need for packing off wireline. Suffice it to say that state-of-the-art communications technology may be applied to the purpose of the invention, and is entirely suitable for use therein.

Power module 44 lies below telemetry and communications module 42 and accommodates the electric power requirements of module 42 as well as instrumentation and control module 46 and flow distribution module 48 associated with torque compensation assembly 32. The power source provided by module 44 may comprise batteries or a turbine-driven alternator located above torque compensation assembly 32, such devices being known in the art. Further, an alternator driven by downhole motor 18 may be employed, although providing conductors between the alternator and modules above torque compensation assembly 32 may prove unwieldy although feasible. It is also contemplated that power may be supplied via drill string 10 with integral or internal umbilical electrical conductors, in lieu of a downhole power source. In such a case it would also be possible to employ the same conductors as a communications link.

Instrumentation and control module 46 includes sensors for acquiring borehole attitude and rotary motion and position information, as well as a microprocessor-based CPU, with memory, for retaining and processing such information, as well as a logic and servo-control system to modulate the function of the flow distribution module 48. Control may be effected by commands received from an operator via surface control module 15 on rig 14, or automatically by "closed loop" servo-feedback control as a function of preprogrammed instructions to the control module related to the planned borehole trajectory. Of course, a combination of an operator-based and closed-loop system may be employed, as desired.

Flow distribution module 48 directs and controls flow of drilling fluid from drill string 10 between two paths through torque compensation module 50, the other element in torque compensation assembly 32. It will be understood and appreciated by those of skill in the art that the bore 38 through swivel assembly 30 continues via communicating bores (see FIG. 2, shown in broken lines) through modules 42, 44, 46 and 48, which distribute the fluid flow to and within module 50, the lower bore of module 50 directing drilling fluid to motor 18.

Flow distribution module 48 includes a motorized (hydraulic or electric) valve which allocates or apportions drilling fluid flow between a direct path to downhole motor 18 and a convoluted path through a torque-generating mechanism. The direct path may also be termed a "passive" path, while the torque-generating path may be termed an "active" path as the fluid performs work in module 50 before being exhausted to motor 18. Various types of valve assemblies are usable within flow distribution module 48, as known in the art and commensurate with the requirement that the valve design and materials accommodate the erosive and abrasive flow of drilling fluids for an extended period of time.

Downhole motor 18 of any of the aforementioned designs (turbine, Moineau or vane-type) or any other suitable configuration known in the art is secured to the lower end of torque compensation module 50 and, as noted previously, drives drill bit 22 through output shaft 20 (see FIG. 1).

FIG. 3 of the invention depicts torque compensation assembly 32, comprising flow distribution module 48 and torque compensation module 50. As shown, flow distribution module 48 includes a poppet-type valve element 52, the axial motion of which is controlled by valve actuator/controller 54. It is contemplated that a valve assembly adapted from a positive-pulse MWD system may be employed in this capacity. The axial position of valve element 52, which (by virtue of its frusto-conical configuration) affects the flow area 56 between element 52 and valve seat 58, directs or apportions drilling fluid flow (see arrows) between a passive path through module 50 afforded by axial bore 60 and an active or torque-generating path afforded by convoluted path 62 through interleaved static turbine members 64 and 66. Elements 64 may be termed rotor elements and elements 66 may be termed 11 stator elements 11 for the sake of convenience by their relative locations, although both sets of elements are fixed in place to the outer housing 68 of module 50, rotor elements indirectly so via their connection to tubular bore mandrel 70, which in turn is secured to outer housing 68 through orifice plates 72 and 74 at the top and bottom of path 62. Drilling fluid flow diverted from bore 60 enters convoluted path 62 through orifices 76 in plate 72, and exits path 62 through orifices 78 in plate 74, rejoining the flow through axial bore 60 before entering downhole motor 18 to power same.

One of the most noteworthy aspects of the embodiment of FIG. 3 is its maximum torque output, relative to fluid mass flux through the active path of the module. This is because the turbine-like arrangement of interleaved members 64 and 66 is permanently stalled, thus delivering peak or maximum available torque for a given fluid mass flux.

In operation, the preferred embodiment of the drilling assembly of the present invention will be operated generally as with conventional navigational or so-called "steerable" drilling assemblies using deviation devices. However, the presence of swivel assembly 30 permits continual drill string rotation during both straight and oriented drilling to greatly reduce axial drag on the string 10 when drill pipe is employed. The torque compensation assembly 32 permits rotational adjustment of TFO for oriented drilling independent of drill string manipulation, and either right-hand or left-hand rotation of bottomhole assembly 16 independent of drill string rotation, in the latter instance preserving net right-hand rotation of the drill bit at viable rotational speeds for drilling.

If a coiled tubing string is employed, the tubing remains rotationally stationary during both oriented and straight drilling, and only the bottomhole assembly 16 rotates during straight drilling, the rotational capability of torque compensation assembly 32 again providing for rotational adjustment of TFO for oriented drilling. In each case, the system may operate in a closed-loop mode, an operator-controlled mode, or some combination thereof, depending upon operator preference and the communication link employed, if any.

As noted above and as illustrated in FIG. 4, an alternative embodiment of the apparatus of the invention having particular applicability to short-radius drilling is depicted. The term "short-radius" drilling may be defined as drilling a wellbore including arcuate or curved segments drilled on a radius of less than about one hundred feet, or thirty meters. Stated in terms of direction change per unit of wellbore segment drilled, this would equate to about 0.5° to 1.5° per foot of wellbore, or about 1.5° to 4.5° per meter.

Figure 4:
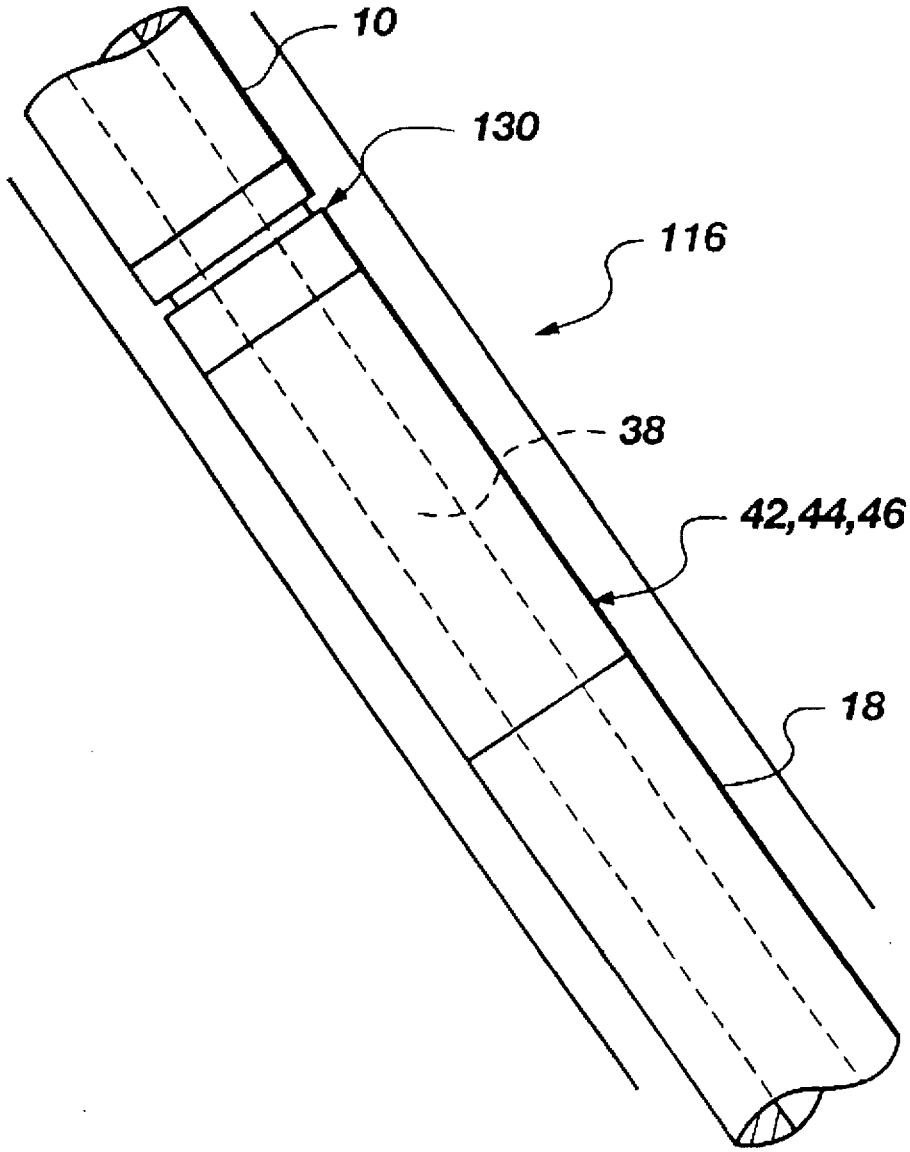
FIG. 4 is an enlarged schematic of the component parts of a second, alternative embodiment of the apparatus of the present invention having particular applicability to short-radius drilling.

Elements of the apparatus of FIG. 4 previously described with respect to FIG. 2 are identified by the same reference numeral, and no further description thereof will be provided. In the embodiment of FIG. 4, rotation of the bottomhole assembly 116 without rotation of drill string 10 would be effected by employing a torque-sensitive clutch 130 which would be actuated by the reactive (left-hand) torque of the motor 18 at some given torque to effect slow left-hand rotation of the bottomhole assembly 116 during straight drilling. Clutch 130 may comprise a mechanical slip clutch using frictionally-engaged elements, or a fluid or so-called "visco" clutch of the type used to distribute torque between the wheels of a four-wheel drive vehicle. Clutch 130 may also be of any other suitable design or configuration known in the art. For orientation purposes, pulses of high drilling fluid flow could be used to incrementally rotate the assembly. Curved or oriented drilling would be effected with drilling fluid flow below the threshold for clutch release. This alternative embodiment of the invention is less preferred, as it would restrict power output from the motor 118 and thus ROP during nonlinear drilling. If such an alternative were employed, the clutch 130 would be employed in lieu of flow distribution module 48 and torque compensation module 50 and positioned as shown in FIG. 4 at the top of bottomhole assembly 116 secured to drill string 10. Swivel assembly 30 would be eliminated as redundant to the independent rotational capability provided bottomhole assembly 116 by the clutch 130. The clutch 130 would be designed to disengage upon application of, for example, 75% of maximum operating torque of the downhole motor with which the clutch is employed. Either frictional forces in the clutch 130 would have to be controlled or some other rotational speed control mechanism employed to maintain the rotation of the bottomhole assembly 116 in a moderate range, on the order of ten to twenty revolutions per minute, to permit TFO adjustments preliminary to and during oriented drilling. Optionally, a two-mode, two-speed gear mechanism might be employed so that in one mode torque might be used to adjust TFO, while in a second mode a higher rotational speed is permitted for straight drilling. A mechanism might be employed, as desired and as described with respect to swivel assembly 30, to disable the clutch 130 so as to provide a locking or free-wheeling connection across the clutch, and/or to change between rotational speed modes. Clutch, gear, mode-change and locking mechanisms all being well-known in the mechanical arts and specifically in the drilling art, no further details thereof are necessary as provided herein.

In operation, the alternative embodiment of the invention would provide incremental adjustment of TFO via short drilling fluid flows high enough to generate enough reactive motor torque for clutch release, the rotational position of bottomhole assembly 116 being sensed as in the preferred embodiment. Following rotational orientation, oriented drilling would be conducted at flow rates and under weight on bit controlled so as not to exceed the torque level required to release the clutch 130. For straight drilling, high flow rates and adequate weight on bit would be employed to ensure clutch release and continuous rotation of the bottomhole assembly 116. As noted previously, if a clutch locking or disabling mechanism is employed, the bottomhole assembly 116 might be oriented, the clutch 130 locked, and then oriented drilling conducted without regard to flow rate and weight on bit.

While the present invention has been described in terms of certain preferred and alternative embodiments, those of ordinary skill in the art will understand and appreciate that it is not so limited. Many additions, deletions and modifications to the embodiments illustrated and described herein as well as to their discrete components may be made without departing from the scope of the invention as hereinafter claimed.

What is claimed is:

1. A drilling assembly for optionally drilling contiguous substantially linear and nonlinear wellbore segments through a subterranean formation, comprising:

a drill string having a longitudinal axis;

a bottomhole assembly, including:

a downhole motor adapted to be driven by a flow of drilling fluid supplied to said bottomhole assembly through said drill string and having an output shaft;

a drill bit having a longitudinal axis and connected to said output shaft;

a deflection structure for inducing said bottom hole assembly to drill a nonlinear wellbore segment; and a torque compensation assembly for providing right-hand torque to said bottomhole assembly responsive to a portion of said drilling fluid flow, said torque compensation assembly further including a valve assembly for varying the magnitude of said portion of said supplied drilling fluid flow to vary the degree of torque compensation provided to said bottomhole assembly; and a swivel assembly interposed between and connected to a lower end of said drill string and an upper end of said bottomhole assembly to permit mutual rotational motion therebetween.

2. The drilling assembly of claim 1, wherein said valve assembly is adapted to vary said degree of torque compensation to maintain said bottomhole assembly in a rotationally static position or to cause said bottomhole assembly to rotate.

3. The drilling assembly of claim 2, wherein said rotation of said bottomhole assembly responsive to said valve assembly may be either right-hand or left-hand rotation.

4. The drilling assembly of claim 1, further including a sensor assembly within said bottomhole assembly for sensing rate of rotation and rotational position of said bottomhole assembly.

5. The drilling assembly of claim 4, further including a processing and control assembly for causing said valve assembly to vary said portion of said drilling fluid flow responsive to at least one of said rate of rotation and said rotational position sensed by said sensor assembly.

6. The drilling assembly of claim 5, further including a communication link between said sensor assembly and the surface of the earth to provide signals representative of said rate of rotation and rotational position of said bottomhole assembly to a drilling operator at said surface, and to provide signals from said surface to said processing and control assembly to selectively vary said portion of said drilling fluid flow to conform said wellbore segments drilled by said drilling assembly to a desired path.

7. The drilling assembly of claim 5, wherein said processing and control assembly includes a preprogrammed wellbore path, and is adapted to vary said portion of said drilling fluid flow to conform said wellbore segments drilled by said drilling assembly to said preprogrammed wellbore path.

8. The drilling assembly of claim 7, further including a communication link between said sensor assembly and the surface of the earth to transmit signals representative of said rate of rotation and rotational position of said bottomhole assembly to a drilling operator at said surface, and to transmit signals from said surface of the earth to said processing and control assembly to selectively vary said portion of said drilling fluid flow through said valve assembly to alter said preprogrammed wellbore path.

9. The drilling assembly of claim 1, wherein said swivel assembly is selectively lockable to prevent said mutual rotational movement.

10. The drilling assembly of claim 1, wherein said drill string comprises a plurality of pipe joints.

11. The drilling assembly of claim 1, wherein said drill string comprises a coiled tubing string.

12. The drilling assembly of claim 11, wherein said bottomhole assembly further includes a thruster for applying axial force to said bottomhole assembly and through said drill bit against a subterranean formation being drilled.

13. The drilling assembly of claim 1, wherein said downhole motor comprises a positive displacement motor driven by a drilling fluid.

14. The drilling assembly of claim 13, wherein said drilling fluid is selected frown the group of fluids comprising liquid, gas and foam.

15. The drilling assembly of claim 1, wherein said downhole motor comprises a drilling fluid-driven turbine.

16. The drilling assembly of claim 1, wherein said torque compensation assembly comprises a drilling fluid-driven turbine assembly.

17. The drilling assembly of claim 16, wherein said drilling fluid-driven turbine assembly comprises a static turbine rotationally fixed to said bottomhole assembly and including fixed, interleaved stator and rotor elements.

18. The drilling assembly of claim 16, wherein said turbine assembly includes an axial passage therethrough surrounded by interleaved stator and rotor elements, and a valve assembly at the drill string end thereof for varying flow of said drilling fluid between said axial passage and said interleaved stator and rotor elements.

19. A method for optionally drilling contiguous, substantially linear and nonlinear wellbore segments through a subterranean formation, comprising:

providing a drill string having a longitudinal axis, and a bottomhole assembly at a lower end of said drill string, said bottomhole assembly including a downhole motor for rotating a drill bit having a longitudinal axis;

disposing said bottomhole assembly on said drill string in a wellbore;

causing said downhole motor to rotate said drill bit; and controlling rotational orientation of said downhole motor independently of rotational orientation of said drill string, including rotating said drill string and said downhole motor at different rates.

20. The method of claim 19, wherein controlling includes rotating said downhole motor while maintaining said drill string in a rotationally stationary mode.

21. A drilling assembly for optionally drilling contiguous substantially linear and nonlinear wellbore segments through a subterranean formation, comprising:

a drill string having a longitudinal axis;

a bottomhole assembly, including:

a downhole motor having an output shaft;

a drill bit having a longitudinal axis and connected to said output shaft;

a deflection structure for inducing said bottomhole assembly to drill a nonlinear wellbore segment; and a torque compensation assembly comprising a drilling fluid-driven turbine assembly for providing right-hand torque to said bottomhole assembly; and a swivel assembly interposed between and connected to a lower end of said drill string and an upper end of said bottomhole assembly to permit mutual rotational motion therebetween.

22. The drilling assembly of claim 21, wherein said turbine assembly comprises a static turbine rotationally fixed to said bottomhole assembly and including fixed, interleaved stator and rotor elements.

23. The drilling assembly of claim 21, wherein said turbine assembly includes an axial passage therethrough surrounded by interleaved stator and rotor elements, and a valve assembly at the drill string end thereof for varying flow of said drilling fluid between said axial passage and said interleaved stator and rotor elements.

24. A method for optionally drilling contiguous, substantially linear and nonlinear wellbore segments through a subterranean formation, comprising:

providing a drill string having a longitudinal axis, and a bottomhole assembly at a lower end of said drill string, said bottomhole assembly including a downhole motor for rotating a drill bit having a longitudinal axis;

disposing said bottomhole assembly on said drill string in a wellbore;

causing said downhole motor to rotate said drill bit; and controlling rotational orientation of said downhole motor independently of rotational orientation of said drill string, including rotating said drill string and said downhole motor in different directions.

* * * * *

UNITED STATES PATENT AND TRADEMARK OFFICE

CERTIFICATE OF CORRECTION

PATENT NO. : 5,738,178
DATED : Apr. 14, 1998
INVENTOR(S) : Williams et al.

It is certified that error appears in the above-identified patent and that said Letters Patent is hereby corrected as shown below:

Column 3, line 5, delete "bottom hole", both occurrences, and insert --bottomhole--, both occurrences.

Column 4, line 29, delete "well bore" and insert --wellbore--.

Column 6, line 49, delete "slip-ting" and insert --slip-ring--.

Column 7, line 61, delete "rotor elements" and insert --rotor element--.

Column 7, line 61, delete the numeral "11".

Column 7, line 62, delete the numeral "11".

UNITED STATES PATENT AND TRADEMARK OFFICE

CERTIFICATE OF CORRECTION

PATENT NO. : 5,738,178
DATED : Apr. 14, 1998
INVENTOR(S) : Williams et al.

It is certified that error appears in the above-identified patent and that said Letters Patent is hereby corrected as shown below:

Column 7, line 62, delete the numeral "11".

Column 9, line 60, delete "bottom hole" and insert --bottomhole--.

Column 11, line 3, after "turbine", insert --assembly--.

Column 11, line 29, after "contiguous", insert a comma --,--.

Signed and Sealed this

Twenty-ninth Day of June, 1999

*Attest:*

Q. TODD DICKINSON

*Attesting Officer*

*Acting Commissioner of Patents and Trademarks*